United States Patent [19]

Robins

[11] 4,207,449

[45] Jun. 10, 1980

[54] SAFETY SHIELD FOR TERMINAL

[75] Inventor: Charles T. Robins, Swarthmore, Pa.

[73] Assignee: Gould Inc., Rolling Meadows, Ill.

[21] Appl. No.: 921,470

[22] Filed: Jul. 3, 1978

[51] Int. Cl.[2] ..... H01H 9/00

[52] U.S. Cl. ..... 200/308

[58] Field of Search ..... 200/308, 153 R, 153 G, 200/293, 50 B, 284, 304, 305

[56] References Cited

U.S. PATENT DOCUMENTS 3,213,241 10/1965 Gelzheiser et al. ..... 200/308

*Primary Examiner*—Houston S. Bell

*Attorney, Agent, or Firm*—Ostrolenk, Faber, Gerb & Soffen

[57] ABSTRACT

A single pole molded case circuit breaker having a wire grip load terminal with a clamping screw is provided with a slidable insulating shield movable automatically between an active and inactive position when the circuit breaker contacts are closed and open, respectively. In its active position, the shield blocks access to the clamping screw. The latter is accessible when the shield is in its inactive position.

10 Claims, 3 Drawing Figures

SAFETY SHIELD FOR TERMINAL

This invention relates to circuit breakers in general and more particularly relates a safety device which prevents access to the load terminal screw when the circuit breaker contacts are closed.

In a typical circuit breaker for home and light industrial applications, such as the circuit breaker illustrated in U.S. Pat. No. 2,996,589 issued Aug. 15, 1961 to F. E. Myers for a Pivoted Bimetal, there is a plug-in type line terminal and a load terminal having a wire grip including a clamping screw. The latter is accessible for connecting or disconnecting a load wire even while the circuit breaker is energized. Thus, unless the electrician and/or home owner remembers either to turn off the breaker or shut off the power to the load center wherein the breaker is mounted, there is inherent danger of electrocution.

To minimize the danger of electrocution by making contact with an energized load terminal, this invention makes it essentially impossible to gain access to the load terminal clamping screw unless the circuit breaker contacts are open. This is accomplished by placing an insulated shield in front of the load terminal screw and connecting such shield to move back and forth as the contacts are engaged and disengaged. With the contacts disengaged the shield is retracted so as not to interfere with access to the clamping screw. However, when the contacts are closed the shield is so positioned that a tool cannot engage the clamping screw.

Accordingly, a primary object of the instant invention is to provide a safety device which blocks access to the load terminal clamping screw when the circuit breaker contacts are closed.

Another object is to provide a safety device of this type which is withdrawn automatically upon opening of the circuit breaker contacts.

A further object is to provide a safety device of this type consisting of a single elongated insulating member slidably mounted and operatively connected to the manual operating handle of the circuit breaker.

These objects as well as other objects of this invention shall become readily apparent after reading the following description of the accompanying drawings in which:

In FIG. 2 the shield is shown in its active or blocking position in relation to key elements associated therewith and in FIG. 3 the shield is shown in its inactive or non-blocking position in relation to these elements.

Figure 1:
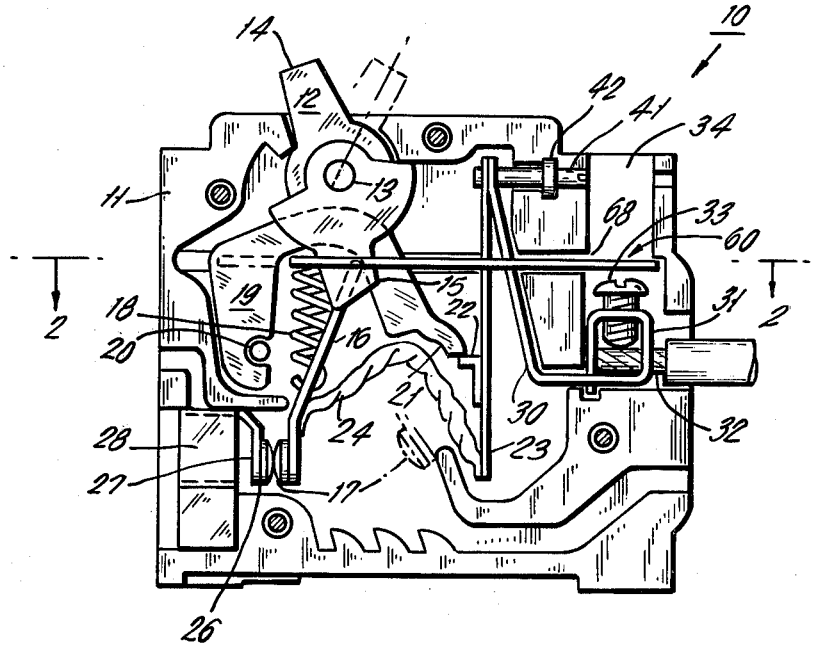
FIG. 1 is a side elevation of a single pole molded case circuit breaker including the safety shield of the instant invention, with the near housing wall of the circuit breaker removed to better reveal the current carrying and contact operating elements.
Figure 2:
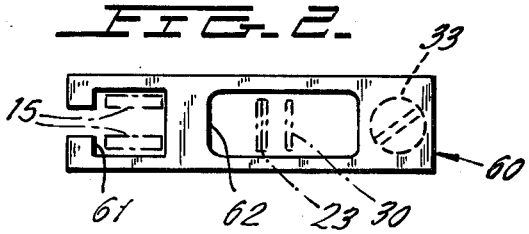
FIGS. 2 and 3 are plan views of the safety shield looking in the direction of arrows 2—2 of FIG. 1.
Figure 3:
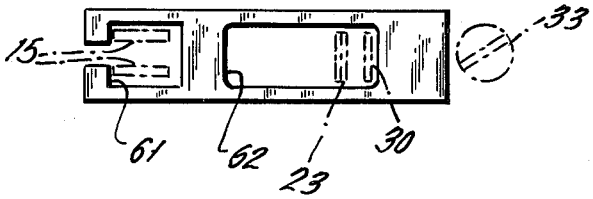

Now referring to the figures. Circuit breaker 10 is of a type described generally in the aforesaid U.S. Pat. No. 2,996,589 and includes a one-inch wide insulating housing. Only one of the housing sections 11 is illustrated. Section 11 supports operating member 12 at pivot 13. Member 12 includes manually engageable section 14 extending externally of housing 11 and another section 15 generally diametrically opposed to section 14. Section 15 is bifurcated and pivotally supports the upper or forward end of movable contact arm 16 whose rear end carries movable contact 17. Coiled tension spring 18 is connected between contact arm 16 and a point on latchable cradle 19 intermediate the ends thereof. Cradle 19 is pivotally mounted on embossment 20 located at one end of cradle 19 whose other end is formed with latching tip 21 normally engaged by releasable latch 22 carried by bimetal strip 23. Flexible conductor 24 connects the free end of bimetal strip 23 to movable contact arm 16.

Movable contact 17 is engageable with and disengageable from stationary contact 26 mounted on strap 27. The latter which is part of a formed conducting member including female type plug-in line terminal 28 engageable with a male line terminal stab in a panelboard (not shown). In a manner well known to the art, operation of manual operating handle 14 to the phantom or Off position of FIG. 1 repositions the forward end of movable contact arm 16 relative to the line of action for main spring 18, until a point is reached where the latter is free to pivot arm 16 counterclockwise to the phantom position of FIG. 1. In this position wherein circuit breaker 10 is open in that movable contact 17 is separated from stationary contact 26. When bimetal 23 overheats and moves to the right with respect to FIG. 1, latch 22 releases cradle 19 so that it pivots clockwise thereby changing the relative position of the line of action of main spring 18 relative to arm 16 until spring 18 is positioned so as to separate movable contact 17 from stationary contact 26.

The forward end of bimetal 23 is secured to one end of load terminal strap 30 whose other end is formed as part of a wire grip 31 which receives and holds conductor 32 extending from a circuit external of circuit breaker 10. The wire grip 31 also includes clamping screw 33 which directly engages conductor 32.

Wire grip 31 is disposed at the rear of elongated recess 34 having its entrance at the front of housing 11. The head of clamping screw 33 is disposed at the forward end thereof so as to be engageable by a screwdriver inserted into recess 34 through its forward end or entrance.

The forward end of strap 30, where it connects with bimetal 23, is connected to the front end of adjusting screw 41 which is threadably engaged with and extends through nut 42 captured in a recess of housing 11 so as to be non-rotatable.

Bifurcated section 15 of manual operating member 12 extends through aperture 61 at one end of elongated shield 60. The latter is constructed of insulating sheet material and also includes an elongated central aperture 62 providing clearance for bimetal 23 and its support 30. Shield 60 is slidably mounted by having the longitudinal edges thereof disposed within grooves 68 of housing 11.

With the circuit breaker in its closed or On position shown in FIG. 1, the end of shield 60 remote from aperture 61 extends into recess 34 at a position slightly forward of clamping screw 33. Now shield 60 is in its blocking or active position to prevent a tool from being inserted through the forward entrance of recess 34 to engage the live load terminal clamping screw 33. When operating member 12 is is pivoted clockwise to the circuit breaker Open position (not shown), bifurcated section 15 moves to the left with respect to FIG. 1 carrying shield 60 to the left. Now the right end of shield 60 has moved far enough to the left with respect to FIG. 1, to permit a tool to be inserted through recess 34 into operating engagement with clamping screw 33.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. An electrical switch including a housing, relatively stationary and movable contacts within said housing and operable into and out of engagement, spaced first and second terminals supported on said housing for connecting said switch into a circuit external of said housing, means within said housing connecting said contacts in circuit between said terminals, a recess in said housing, said recess having an entrance, wire grip means at said first terminal including a clamping screw disposed for operation by a tool inserted through said entrance into said recess, a shield operatively connected to said movable contact for movement between inactive and active positions when said movable contact is respectively disengaged from and engaged with said movable contact, said shield when in said inactive position being operatively disposed to permit said screw to be operated by a tool extending through said entrance into said recess, said shield when in said active position having a section entered into said recess and interposed between said entrance and said screw in operative position blocking engagement of said screw by a tool inserted into said recess through said entrance whereby said screw is inaccessible when said contacts are engaged.

2. A switch as set forth in claim 1 in which the shield comprises an elongated sheet-like element mounted for longitudinal movement.

3. A switch as set forth in claim 1 in which there is a manually operable member operatively connected to said movable contact and movable between switch open and closed positions to respectively operate said movable contacct out of and into engagement with said stationary contact, said manually operable member having a portion drivingly connected to said shield for movement of the latter between its said active and inactive positions.

4. A switch as set forth in claim 3 in which the shield comprises an elongated sheet-like element having an aperture through which said portion of said member extends.

5. A switch as set forth in claim 4 in which the shield is mounted for longitudinal sliding movement.

6. A switch as set forth in claim 4 also including an arm having said movable contact at one end thereof, said arm at its other end being pivotally connected to said portion of said member.

7. A switch as set forth in claim 6 in which the aperture is near one end of the element, said section of said element being at the other end of the latter.

8. A switch as set forth in claim 7 in which the shield is mounted for longitudinal sliding movement.

9. A switch as set forth in claim 1 in which the second terminal is of the plug-in type, said first and second terminals being disposed at opposite ends of the housing.

10. A switch as set forth in claim 9 in which the shield comprises an elongated sheet-like element mounted for longitudinal movement.

* * * * *